US007241042B2

(12) United States Patent
Tronquet et al.

(10) Patent No.: US 7,241,042 B2
(45) Date of Patent: Jul. 10, 2007

(54) FASTENING SYSTEM FOR FIXING A LIGHT SOURCE ON A COUNTERPART OF A MOTOR VEHICLE HEADLIGHT, AND A METHOD OF APPLYING IT

(75) Inventors: Guillaume Tronquet, Bobigny (FR); Daniel Josquin, Bobigny (FR)

(73) Assignee: Valeo Vision, Bobigny Cedex (FR)

( * ) Notice: Subject to any disclaimer, the term of this patent is extended or adjusted under 35 U.S.C. 154(b) by 162 days.

(21) Appl. No.: 10/994,104

(22) Filed: Nov. 19, 2004

(65) Prior Publication Data

US 2005/0111230 A1 May 26, 2005

(30) Foreign Application Priority Data

Nov. 21, 2003 (FR) ..... 03 13650

(51) Int. Cl.
*H01R 33/00* (2006.01)

(52) U.S. Cl. ..... 362/649; 362/507; 362/538

(58) Field of Classification Search ..... 362/649
See application file for complete search history.

(56) References Cited

U.S. PATENT DOCUMENTS 4,392,189 A * 7/1983 Hough et al. ..... 362/306
4,403,276 A * 9/1983 Blaisdell ..... 362/645
4,819,133 A 4/1989 Kochi et al.
5,036,439 A * 7/1991 Hoffmann et al. ..... 362/459
5,144,189 A 9/1992 VanHeeswijk et al.
5,744,901 A * 4/1998 Friederichs et al. ..... 313/113
5,889,360 A * 3/1999 Frey et al. ..... 313/318.01

FOREIGN PATENT DOCUMENTS

| | | |
|---|---|---|
| DE | 29908298 | 9/2000 |
| EP | 1283390 | 12/2003 |
| FR | 2742709 | 6/1997 |

OTHER PUBLICATIONS

French Search Report Jul. 5, 2004.

* cited by examiner

*Primary Examiner*—Ali Alavi
*Assistant Examiner*—Hargobind S. Sawhney
(74) *Attorney, Agent, or Firm*—Morgan & Finnegan, LLP

(57) ABSTRACT

This invention provides apparatus for projecting light, for a motor vehicle, comprising:
a light source having a discharge bulb, a high tension module, and a bulb base for making the connection between the bulb and the high tension module,
a counterpart comprising a reflector and a lamp holder, with the said lamp holder holding the bulb in front of the reflector, and
a fastening system for fixing the light source on the counterpart and situated at least partly around the lamp holder, the fastening system comprising:
a rotatable rigid sleeve, and
an electrically conductive flexible annular ring situated inside the rigid sleeve and having tongues in electrical and/or mechanical contact with the light source.

The invention also provides a method for fitting the said apparatus.

12 Claims, 6 Drawing Sheets

FASTENING SYSTEM FOR FIXING A LIGHT SOURCE ON A COUNTERPART OF A MOTOR VEHICLE HEADLIGHT, AND A METHOD OF APPLYING IT

FIELD OF THE INVENTION

This invention relates to a fastening system for fixing a light source on a counterpart of a motor vehicle headlight. In particular, the invention relates to a fastening system which enables various types of light sources incorporating a discharge bulb to be fitted in place.

BACKGROUND OF THE INVENTION

The invention finds applications in the automotive field, and more precisely in the field of the projection of light for motor vehicles. In particular, it is applicable for the fastening of a light source with a possibility of interchangeability between light sources of different types.

At the present time, apparatuses for projecting light (or headlights) for motor vehicles are provided with light sources which may be of different kinds. In particular, front headlights of vehicles are equipped with light sources which may be of two different kinds, namely: a first kind with a halogen bulb, and a second kind with a discharge bulb. In the second case, the light source is also equipped with a high tension module which provides the electrical power supply for the discharge bulb.

Among light sources with discharge bulbs, there currently exist two types of light sources which are called a D1 lamp and D2 lamp. Each of these light sources or lamps comprises a discharge bulb, a bulb base and a high tension module. The high tension module is fixed non-removably in the case of a D1 lamp, while on the other hand, it is removable in the case of a D2 lamp. In other words, in the case of a D1 lamp, the high tension module is an integral part of the lamp. In a D2 lamp, the high tension module is not incorporated in the lamp; it consists of an independent component which is removably mounted on the lamp.

One example of a D1 lamp is shown in FIG. 1. This Figure shows a light source 1 comprising a discharge bulb 2, a bulb foot 4 and a high tension module 3. The bulb 2 is fixed securely to the module 3 in the region of the bulb base 4. An optical reflector 5 is formed with a passage hole 6 at the level of a skirt portion 7. The bulb 2 passes through the hole 6. A body 2*a* of the bulb 2 is mounted inside the reflector 5. The bulb base 4 is situated on the outside of the reflector 5. In the D1 lamp assembly shown in FIG. 1, a lamp holder 8, which may for example be of cylindrical circular shape, is an integral part of the reflector 5. The lamp holder 8 and reflector 5 together constitute a single and common component 9, which is referred to as the counterpart of the headlight. The purpose of the lamp holder 8 is to support the discharge bulb 2. It also centres and orientates the discharge bulb 2 inside the reflector 5.

The lamp holder 2 may also be a member separate from the reflector 5. The lamp holder 2 is then not an integral part of the reflector; it is fixed firmly to the reflector during assembly of the headlight. In this case too, the lamp holder 8 and the reflector constitute the counterpart of the headlight.

In the D1 lamp assembly, the discharge bulb 2 is fitted on a high tension module 3 which is fixed to the said bulb. The module 3 has a substantially square outside contour, and is of relatively small size as compared with a D2 lamp and its module which will be described later herein. However, the fact that the module 3 is not removable gives rise to certain disadvantages. In this connection, when a user wants to change the discharge bulb in a headlight of his vehicle, for example because it is faulty, he is obliged to change the whole assembly consisting of the bulb and high tension module. In addition, changing of this bulb and high tension module assembly is a relatively delicate operation, firstly due to the difficulty of access to the D1 lamp and operations that have to be carried out in order to withdraw the faulty assembly and install a new assembly, and secondly due to the risks inherent in the high voltage present in the module. The user is therefore obliged to have the unit changed by a professional, which involves not only the cost of the unit but also a labour charge.

One example of a D2 lamp with its high tension module is shown in FIG. 2. FIG. 2 shows a light source 11 which comprises a discharge bulb 12.

A high tension electrical module 13 is fixed removably on the bulb 12 in the region of a bulb base 14. A reflector 15 is formed with a passage hole 16 close to the skirt portion 17, to allow the bulb 12 to pass through. The body 12*a* of the bulb 12 is mounted inside the reflector 15. The bulb base 14 is situated on the outside of the reflector 15. As for the D1 lamp, the D2 lamp includes a lamp holder 18, which is for example of circular cylindrical form and which may be an integral part of the reflector 15 or, alternatively, a separate component fixed to the reflector 15. The lamp holder 18 and reflector 15 together constitute the counterpart 19 of the headlight.

In the D2 lamp assembly, the bulb has no associated electronic circuitry, that is to say the high tension module is independent of the bulb. In other words, the high tension module is not an integral part of the discharge bulb: it is fixed on the bulb after the bulb has been fitted in the reflector. It is therefore possible, during fitting and removal of the headlight, to disconnect the high tension module from the bulb. This has a certain advantage as compared with the D1 lamp. In this connection, with a D2 lamp when the lamp is faulty, it is possible to change only the bulb and to preserve the initial high tension module. However, changing of a bulb in a D2 lamp is even more delicate than the changing of the bulb and module unit with a D1 lamp. In this connection, not forgetting the difficulty of access which is inherent in a headlight, the user first has to extract the module and withdraw the bulb; he then has to change the bulb and replace the module on the bulb, with all the risks inherent in the high voltage in the module. The user is therefore obliged to get a professional to change the bulb.

At the present time, arrangements are known for fixing a bulb on a counterpart with a D2 lamp. One example of such an arrangement is a closed sleeve. With this closed sleeve, the high tension module is first fixed to the discharge bulb, and then the discharge bulb is mounted in the reflector. The sleeve is then brought into the fastening zone. For this purpose, the high tension module is slid in the sleeve into the fastening zone. The sleeve is then secured to the reflector with a bayonet fitting. Such a fastening sleeve is not well adapted for a D1 light source. In this connection, either the square outer contour of the high tension module in the D1 light source prevents its introduction into the closed sleeve, or else the sleeve would have to have too large a diameter to enable the light source to be fixed on the counterpart subsequently.

It is therefore impossible, with such apparatus, to interchange the two lamps, the D1 and the D2. In other words, a user whose vehicle has a D2 light source cannot later, for cost and availability reasons, introduce a D1 light source into his light projecting apparatus, and vice versa.

There also exist spring fastening systems which are adapted either for D1 lamps or for D2 lamps, but without any possibility of these two types of lamps being interchanged, for reasons of geometry and size.

Motor vehicle headlights also exist which have lamp locking systems which enable several standard types of lamps to be locked in place. Such a system is described for example in Application EP-A-1 108 950.

However, such a system is not well adapted for light sources with discharge bulbs. In this connection, this type of light source with a discharge bulb, connected to a high tension module, must include means which give electrical continuity on the one hand, and screening on the other, in order to avoid leakage from the electromagnetic field. In this connection, in this type of light source, because of the generation of a high voltage by the high tension module, the headlight is subjected to numerous electromagnetic radiations. In order to avoid propagation of the electromagnetic radiation within the vehicle, it is necessary to screen the light projecting apparatus. As to this, the electromagnetic radiations may give rise to numerous disturbances in the electrical assembly of the vehicle. Since a number of functions in a modern motor vehicle are managed by an electronic system, these electromagnetic disturbances may have serious consequences.

The main object of the invention is to overcome the drawbacks of the techniques discussed above, and to enable a bulb to be fixed on a headlight counterpart, with the same fastening system for a D1 lamp as for a D2 lamp. To this end, the invention proposes a fastening system for fixing a light source with a discharge bulb which is adaptable for different types of light sources. This system is particularly well adapted for light sources with discharge bulbs, such as D1 and D2 lamps, because it enables electrical continuity and electromagnetic screening to be ensured in order to avoid leakage of electromagnetic fields into the inside of the vehicle.

SUMMARY OF THE INVENTION

More precisely, the invention provides apparatus for projecting light, for a motor vehicle, comprising:

a light source having a discharge bulb, a high tension module, and a bulb base for making the connection between the bulb and the high tension module, a counterpart comprising a reflector and a lamp holder, with the said lamp holder holding the bulb in front of the reflector, and a fastening system for fixing the light source on the counterpart and situated at least partly around the lamp holder, wherein the fastening system comprises:

a rotatable rigid sleeve, and an electrically conductive flexible annular ring situated inside the rigid sleeve and having tongues in electrical and/or mechanical contact with the light source.

The system of the invention may also incorporate all or some of the following features:

the flexible ring is movable radially, and is not rotatable;

at least one of the tongues is a mechanical holding tongue;

at least one of the tongues is a tongue giving electromagnetic continuity;

at least one of the tongues is a tongue for positioning the lamp;

one of these mechanical holding tongues, for electromagnetic continuity and positioning, ensures preliminary holding of the lamp on the counterpart, before the said lamp is locked in place;

the holding and positioning tongues are movable radially, with an unlocked position and a locked position;

the rigid sleeve includes, on an internal face, at least one first lug which is adapted to push on the holding tongue and to maintain it in a locked position;

the rigid sleeve includes, on an internal face, at least one second lug which is adapted to push on the positioning tongue and to maintain it in a locked position.

The invention also provides a method of fastening a light source on a counterpart of an apparatus for projection of light, by means of the foregoing fastening system. According to this method, the following steps are included:

positioning and fixing the fastening system around one end of a lamp holder of the counterpart, inserting a discharge bulb of the light source within the counterpart until a bulb foot of the light source comes into engagement on the fastening system or the counterpart, and locking the fastening system by rotation of a part of the said system.

Preferably, the method of the invention may also incorporate, wholly or partly, the following features:

the locking of the fastening system consists in causing the rigid sleeve to be rotated with respect to the flexible annular ring and with respect to the counterpart;

the fastening system is fitted on the lamp holder by exertion of a force to effect snap-fitting and locking.

The invention also provides a motor vehicle, wherein it includes at least one apparatus for projection of light as set forth above.

DETAILED DESCRIPTION OF EMBODIMENTS OF THE INVENTION

From the foregoing explanations it will be understood that the D1 and D2 lamps have very different forms from each other. They do however have a normalised common part. This common part is the bulb base, or lamp base. The lamp base is the rear part of the discharge bulb, whereby the latter is fixed to the high tension module. The bulb base is substantially cylindrical, and is of the same diameter for the D1 and D2 lamps. However, the height between the neck of the bulb base and the base of the high tension module can vary between a D1 lamp and a D2 lamp. In this connection, this height is standardised for a D1 lamp. On the other hand, in a D2 lamp the height depends on the particular high tension module which is used.

The invention accordingly proposes to make use of this feature which is common to both lamps. More precisely, it proposes to fix a fastening system of a D1 lamp and of a D2 lamp around the said common part. The fastening system of the invention is accordingly designed to be positioned around the bulb base of a D1 or D2 light source. This fastening system enables the discharge bulb to be held and locked with the lamp holder, that is to say the upper part of the counterpart of the headlight, in the region of the bulb base.

Figure 1:
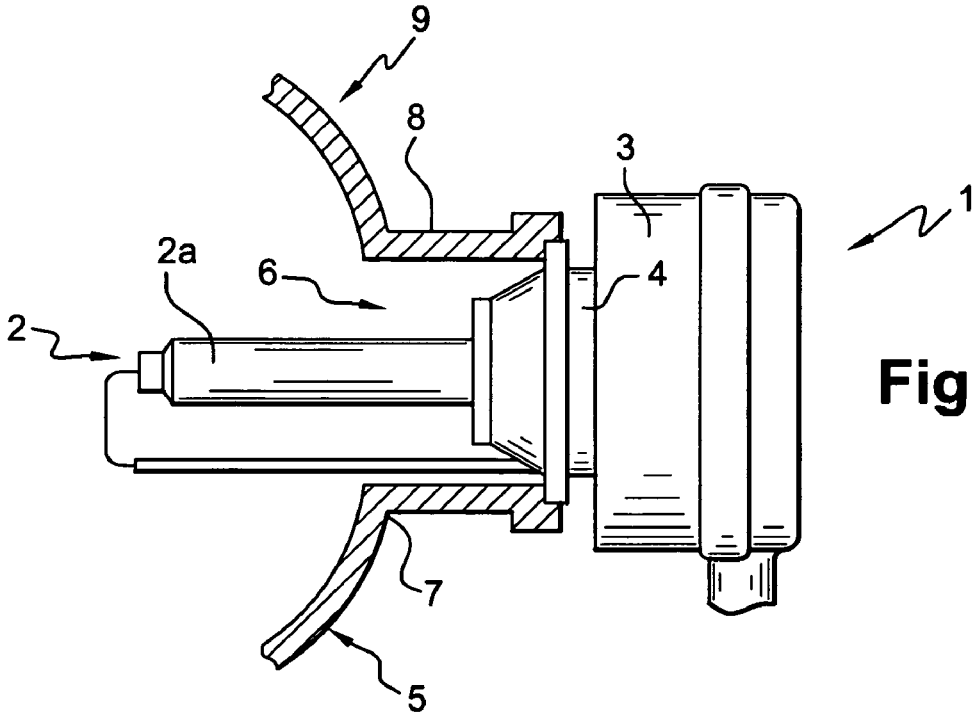
FIG. 1, already described, shows a view, in longitudinal cross section, of a conventional vehicle headlight provided with a D1 lamp.
Figure 2:
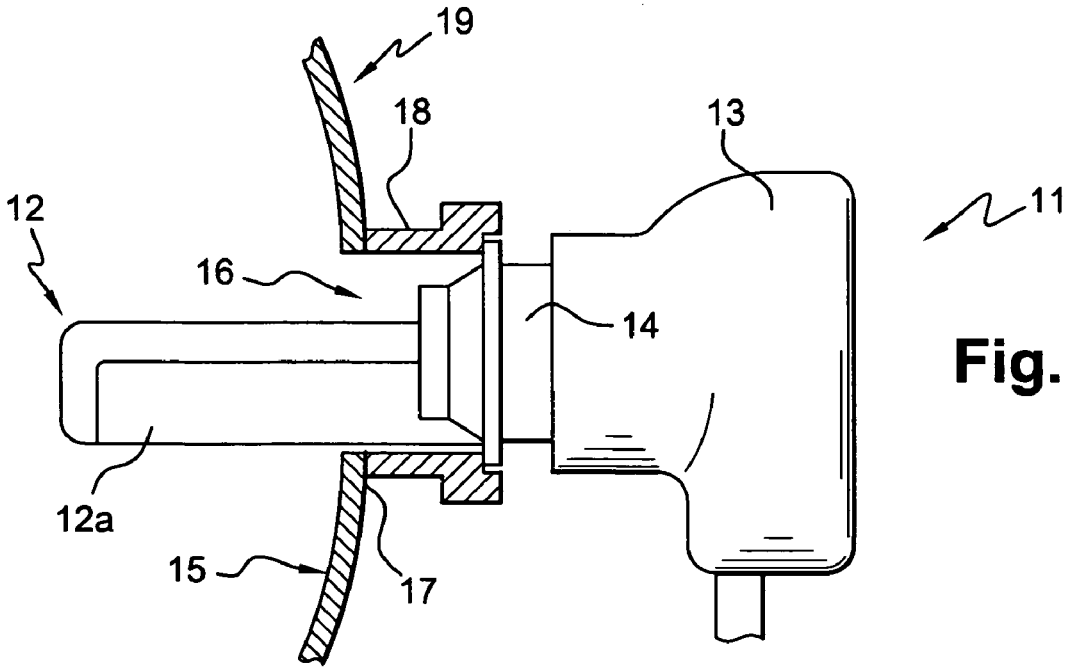
FIG. 2, already described, shows a view, in longitudinal cross section, of a conventional vehicle headlight having a D2 lamp and a high tension module.
Figure 3A:
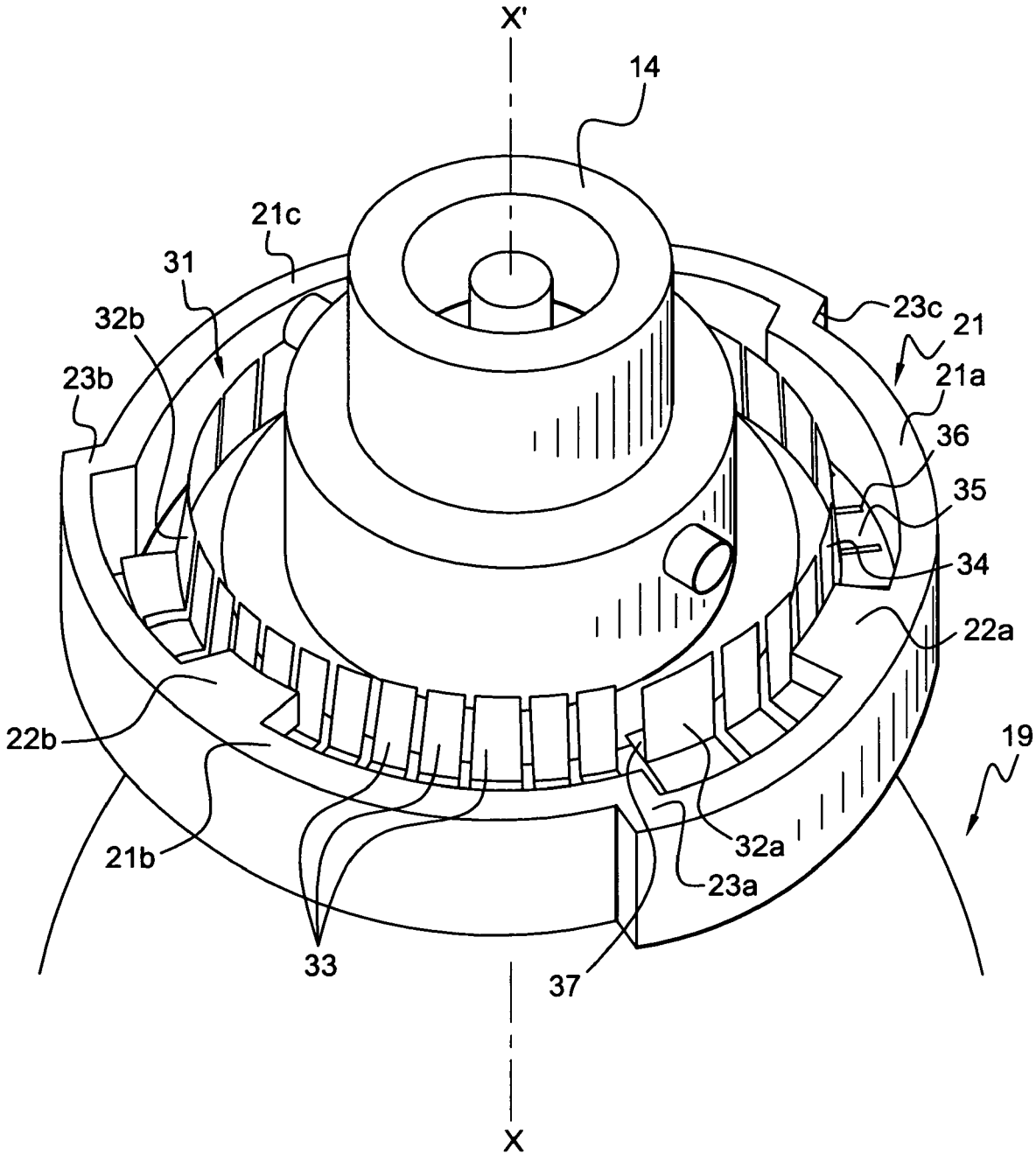
FIGS. 3A and 3B each show a perspective view of the fastening system of the invention, respectively in the case where the system is unlocked and in the case where the system is locked, the system having a D2 lamp.
Figure 3B:
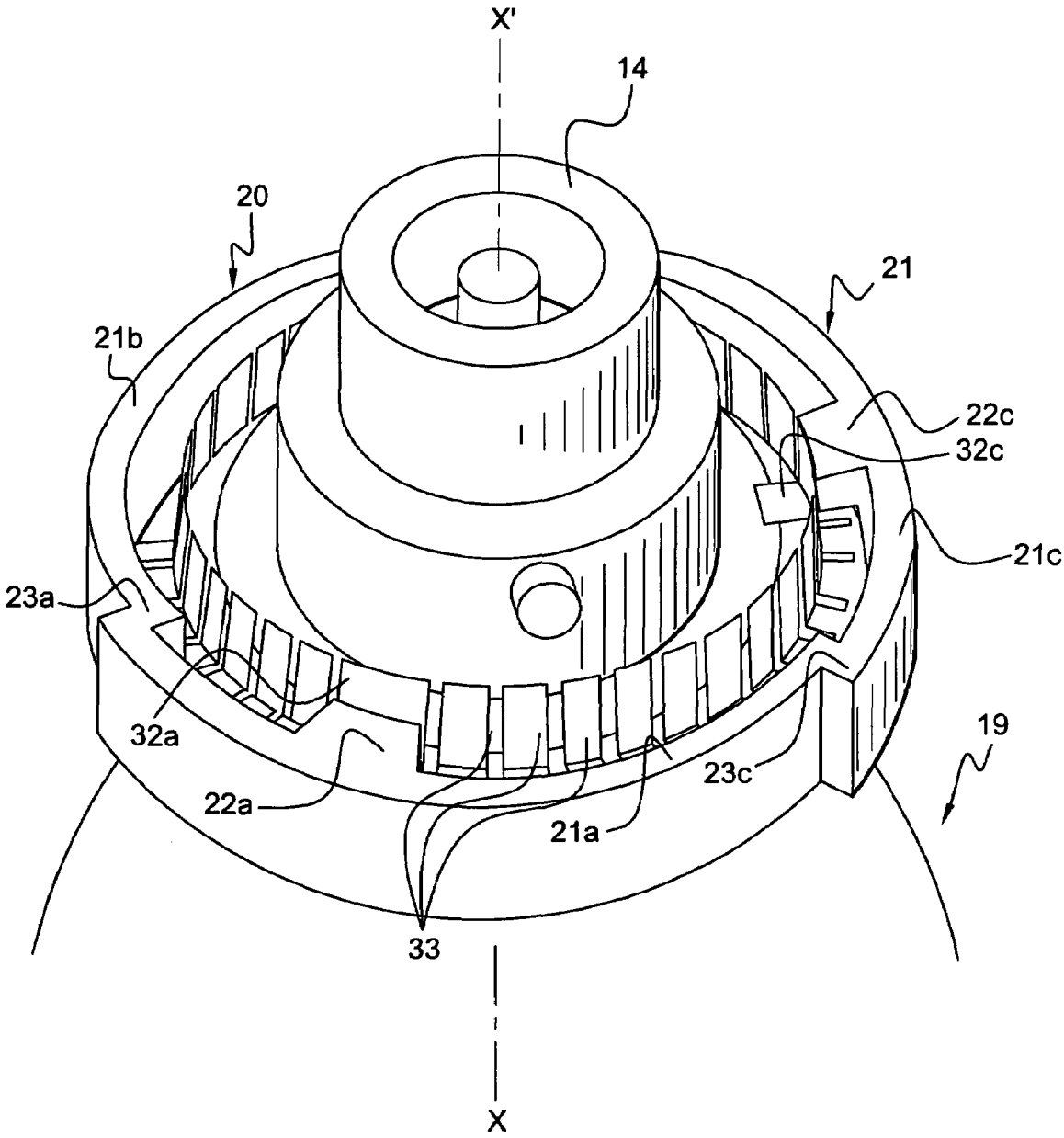

This fastening system of the invention is shown in FIGS. 3A and 3B in perspective views. More precisely, FIG. 3A shows the system in an unlocked system and FIG. 3B shows the system in its locked position.

In FIG. 3A the fastening system 20 is shown mounted on the counterpart 19, for the case where the lamp is a D2 lamp for which the high tension module has no longer been fixed on the bulb base 14. The fastening system 20 includes a rigid sleeve 21 and a flexible annular ring 31. The flexible ring 31 is an electrical conductor. It is fitted inside the rigid sleeve 21. The rigid sleeve 21 is rotatable. The flexible annular ring 31 is not rotatable with respect to the counterpart 19. On the contrary it has one degree of freedom which consists of radial translation with respect to the counterpart of the headlight. In other words, as will be seen later herein, the flexible annular ring 31 is displaceable radially towards the bulb base under the effect of pressure exerted on the rigid ring 21.

The flexible ring 31 is made of a flexible, electrically conductive material, for example a metallic material. It thus ensures an electrical function by internal contact on the counterpart and, at the same time, by contact of the contact tongues on the high tension module. The flexible ring 31 is relatively circular in form; more precisely, it has a circular form where the fastening system is in its locked position; it is circular, in segments or sectors when the fastening system is in its unlocked position. In other words, the flexible ring has a tangential spacing which is larger at one point than at another point. That is to say it is larger at the end of a segment than at the beginning of a segment. This can be achieved by cutting the ring at the end of a segment, which puts the end of the segment naturally behind the rest of the segment.

The said flexible annular ring 31 includes a plurality of tongues. These tongues can be of several kinds, as follows.

Contact tongues, with the reference 33, the role of which is to ensure electrical continuity and electromagnetic screening between the high tension module and the counterpart, by contact with a metallic portion of the lamp.

Holding tongues, with the reference numeral 32, the function of which is to maintain the bulb in position in the counterpart. There may for example be three of these holding tongues. Each of them has a locked position and an unlocked position. These tongues are movable radially.

A positioning tongue, which cannot be seen in FIG. 3A but which has a locked position and an unlocked position. This positioning tongue is also movable radially. The function of the said positioning tongue is to rectify clearances which may exist between the lamp and the lamp holder (or the portion of the counterpart that constitutes a lamp holder), by thrusting the lamp radially into a V-shaped housing formed in the lamp holder and described in greater detail later herein. This positioning tongue may also constitute a kind of locating means for the fastening system.

One or more of these various tongues (i.e. holding tongues, contact tongues and positioning tongue) is also able to provide a function of preliminary holding of the lamp on the counterpart before the lamp has been locked in position. This tongue then enables the lamp to be stable on the counterpart, in a position in which it is ready to be locked.

The tongues are of different dimensions according to their type and their function. The contact tongues are thin and long, so that they will come into contact against an electrically conductive portion of the lamp. The holding tongues are wider than the contact tongues, so that they are able to prevent any change in the position of the lamp in the counterpart when the system is in its locked position. The positioning tongue is thin and long, so that it can be introduced into a housing of the lamp.

Each tongue has a substantially vertical flank portion 34 and a substantially horizontal base portion 35. The flank portion has one free end and one end which is common with one side of the base portion. The side of the base portion opposite to the flank portion is joined to a collar portion 36 which joins several tongues together. The tongues are spaced apart in a plurality of sectors. There are as many sectors of tongues as there are holding tongues. Each sector or segment therefore includes one holding tongue and several contact tongues, the holding tongue being located at the end of the sector. One of the sectors can also include a positioning tongue.

The flank portion of the contact tongues may have a form which is curved to a greater or lesser extent, defining at least one arc of a circle in such a way as to give flexibility to the tongues, so as to enable better contact with the high tension module to be obtained.

The holding tongues comprise, besides a flank portion 34 and base portion 35, a holding arm 37 which lies in the same plane as the base portion 35 at right angles to the flank portion 34 and directed towards the bulb base 14. It is the holding arm 37 that serves to hold the base in the counterpart when the fastening system is in its locked position. It will clearly be understood that with several holding tongues, for example three, spaced symmetrically apart on the flexible annular ring, that is to say around the bulb base, fixed positioning of the bulb base inside the flexible annular ring, and therefore inside the counterpart, is ensured.

The positioning tongue includes, besides a flank portion 34 and a base portion 35, a locating arm situated in the same plane as the base portion 35, at right angles to the flank portion 34 and directed towards the bulb base 14. This locating arm is arranged to be inserted in a housing in the lamp in order to ensure a unique, correct positioning of the bulb in the counterpart.

In the case of FIGS. 3A and 3B, the holding tongues and positioning tongues all have a flank portion 34. This flank portion 34 enables the tongues to ensure, besides their respective functions of holding and positioning, a function of electrical conduction and electromagnetic screening, in the same way as in the contact tongues. In this case, the flank portion of the holding tongues is of approximately the same curved form as the contact tongues.

In a modified version, the holding tongues and positioning tongues may be without any flank portion; in that case they only have their initial function, namely holding and positioning of the bulb in the counterpart.

The flexible annular ring may be formed by pressing and bending from a metallic sheet, the type of metal and thickness of which are chosen according to the desired degree of flexibility. The tongues can also be formed by bending with forms and dimensions which are different according to their function. In particular, the contact tongues may be of curved form to give better electrical contact with the lamp.

The flexible annular ring 31 just described is installed in a rigid sleeve 21. The sectors of the flexible annular ring are located side by side, so that the holding tongue in one sector is beside a contact tongue of another sector.

The rigid sleeve 21 is made in a plastics or metallic material. It is circular in form by segment. In other words, the rigid sleeve 21 is formed from several segments, for example three, which are fixed with respect to each other. Each segment defines an arc of a circle and is joined to another segment through a crank portion. In particular, in FIG. 3A, the rigid sleeve 21 consists of three segments 21*a*, 21*b* and 21*c*. The segment 21*a* (and the segments 21*b* and 21*c* respectively) is separated from the segment 21*b* (and 21*c* and 21*a* respectively) through a crank portion 23*a* (and 23*b* and 23*c* respectively). These crank portions also have the advantage that they facilitate gripping of the ring by the user in order to rotate it.

The rigid sleeve 21 includes first lugs 22*a*, 22*b* (also called projecting portions) which constitute cams. In fact, the rigid sleeve has as many of these first lugs as the flexible annular ring has holding tongues. In the case of FIG. 3A, the rigid sleeve therefore has three first lugs, only two of which can be seen in the drawing. These lugs are adapted so that in the locked position they exert a thrust on the holding tongues towards the bulb base.

The rigid sleeve may include a second lug, not shown in FIG. 3A, which constitutes a cam. This second lug is arranged so that, in the unlocked position, it puts the positioning tongue into a housing in the lamp so as to provide correct positioning for the said lamp.

The rigid sleeve is made in such a way that the flexible annular ring is all against the lower face of the said sleeve and is blocked against upward movement by the lugs of the sleeve. The flexible annular ring may also be blocked against downward movement by further lugs, which are used for the purpose of fixing the assembly of the fastening system on the counterpart.

The rigid sleeve 21 has the function of locking and unlocking the fastening system by rotation about an axis XX' of the system, that is to say by rotation with respect to the flexible annular ring and with respect to the counterpart. In other words, the rigid sleeve is rotatable, while the flexible annular ring is not rotatable, with respect to the counterpart.

In addition, the rigid sleeve may include on its inner face a boss of hard points, for the purpose of preventing the sleeve from regaining a free position. This then enables unlocking to take place without going into a free position.

In the case of FIG. 3A, the fastening system is in its unlocked position. The rigid sleeve is accordingly in an open position with respect to the flexible annular sleeve. In this position, the holding tongues 32 of the flexible ring are each positioned close to a crank portion of the rigid sleeve; the lugs 22 of the rigid sleeve are located in front of the contact tongues, and do not engage on any tongue. The flexible annular sleeve is therefore free of any contact or engagement with a lamp.

By turning the rigid sleeve, for example through an angle of about 40°, the flexible annular sleeve is brought by the lug to its most off-centre level, that is to say to the level of the holding tongue. Each lug 22*a*, 22*b* therefore comes into engagement against a holding tongue 32*a*, 32*b*, pushing that tongue towards the bulb base 14. Under the effect of the thrust exerted by the lug, the holding tongue is again close to the bulb base, or even in engagement against the bulb base, which enables the bulb to be prevented from shifting in the counterpart.

FIG. 3B shows the fastening system of the invention in a locked position, that is to say after the rigid sleeve has been rotated. This Figure shows that in the locked position, the lugs 22*c*, 22*a* of the rigid sleeve 21 are bearing on the holding tongues 32*c*, 32*a* of the flexible ring 31. The holding tongues are then pushed towards the inside of the system, that is to say towards the bulb base 14. They may thus be in engagement against the lamp, and in particular against the bulb base.

Thus, when the fastening system is locked around the bulb as shown in FIG. 3B, the high tension module can then be placed around the bulb base. The high tension module is then in contact with the whole or part of the contact tongues 33, which sets up an electrical contact between the high tension module and these tongues. Besides the electrical contact, the contact tongues provide screening against electromagnetic radiation emitted between the high tension module and the counterpart. In this way, electromagnetic screening is obtained between the high tension module and the counterpart.

Figure 4:
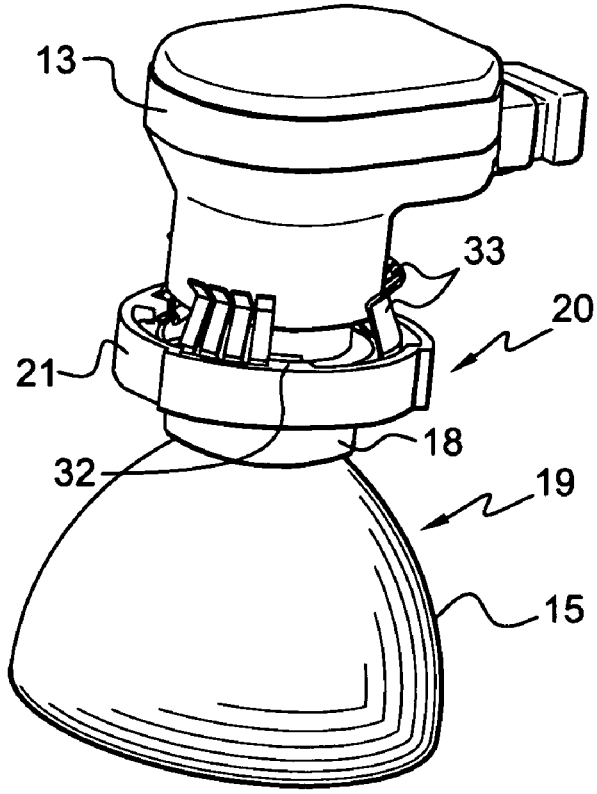
FIG. 4 shows the fastening system of the invention mounted around a D2 light source.

FIG. 4 shows the fastening system of the invention mounted around a D2 light source when the system is locked. This Figure shows the counterpart 19 of the headlight, with its reflector 15 and its lamp holder 18, on which the fastening system 20 of the invention and the D2 lamp is mounted. It can be seen in FIG. 4 that the contact tongues 33 of the fastening system 20 are in electrical contact with the high tension module of the D2 light source. More precisely, in the case of a D2 lamp, the contact tongues are in contact with the connector of the D2 lamp. The holding tongues 32 are in engagement against the bulb base.

Figure 5:
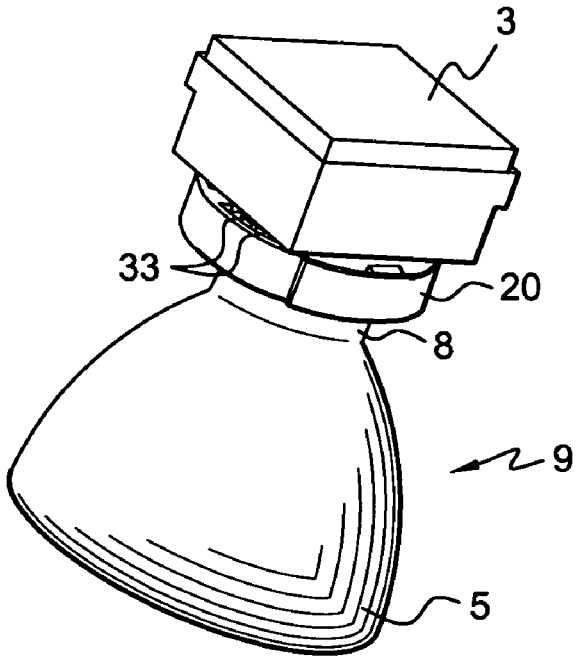
FIG. 5 shows the fastening system of the invention mounted around a D1 light source.

FIG. 5 shows the fastening system of the invention mounted around a D1 light source when the system is locked. FIG. 5 shows the counterpart 9 of the headlight, with the reflector 5 and lamp holder 8 on which the fastening system 20 of the invention and the D1 lamp are mounted. It can be seen in FIG. 5 that the contact tongues 33 of the fastening system 20 are in electrical contact with the D1 lamp through a metallic portion of the lamp situated below the connector 3.

In the example of FIG. 5, the contact tongues are not present over the whole of the circumference of the flexible annular ring, but only over some parts of it. For example, the zone on which a lug will be put into rotation may not have a tongue, so that it has a flat surface between the initial position and the final position of the lug, that is to say between the unlocked and locked positions of the lug.

In the case of FIGS. 3A and 3B on the other hand, there are contact lugs spaced apart over the whole circumference of the flexible annular ring. In that case it is the tangential form, or the circular form by segment, of the annular ring which enables the lugs to bear on each tongue only as far as the locked position.

FIGS. 4 and 5 show that the space between the fastening system 20 and the high tension module 3 of the D1 lamp is smaller than that between the fastening system and high tension module of a D2 lamp. In addition, the module of a D1 lamp has a square shape, the base of which has dimensions greater than the diameter of the fastening system. By contrast, the base of the module of the D2 lamp has a diameter smaller than that of the fastening system. The dimensions of the contact tongues are therefore different in the case of a system for a D1 lamp from those which apply to a system for a D2 lamp. In particular, the contact tongues for a D2 lamp are longer than the contact tongues for a D1 lamp, because they come into contact with the module itself. By contrast, the contact tongues for a D1 lamp come into contact with a portion which is situated below the module, that is to say closer to the bulb base, and they are therefore made shorter. The curvature of the contact tongues is also able to be varied as a function of the lamp concerned.

The fastening system of the invention is therefore identical for D1 lamps and D2 lamps, except for the flexible ring which is able to have different tongue lengths. As will be understood from what follows, this difference is not detrimental, in the sense that it in no way adversely affects interchangeability of the lamps.

Regardless of whether the lamp is a D1 or a D2, the fastening system is positioned and secured by the following method: first of all, the fastening system is made up by assembling the flexible annular ring, adapted for a D1 lamp or a D2 lamp, with the rigid sleeve, and then by inserting this system vertically on the upper part of the counterpart. The system is then secured on the said counterpart by conventional means, for example by force fitting or bayonet fitting or snap-fitting. The fastening system may include, in its upper part below the flexible annular ring, lugs whereby the fastening system can be fixed on the counterpart of the headlight.

In the case of a D1 lamp, the lamp is positioned on the fastening system by placing the discharge bulb inside the counterpart, in a V-shaped housing in the counterpart. The position of the D1 lamp in the fastening system is correct when the positioning tongue is in engagement against the D1 lamp, exerting a thrust on the said lamp at the base of the V-shaped housing. When the D1 lamp is correctly inserted in the fastening system, the fastening system is put into its locked position by bayonet fitting, that is to say by rotating the rigid sleeve about the axis XX', and therefore with rotation of the rigid sleeve with respect to the flexible annular ring.

In the case of a D2 lamp, the discharge lamp is placed inside the counterpart, the bulb base being positioned on the fastening system. The position of the D2 lamp in the fastening system is correct when the lamp is in the V-shaped housing of the counterpart and the positioning tongue is in engagement against the D2 lamp, exerting a thrust on the lamp at the base of the V-shaped housing. When the bulb of the D2 lamp is correctly inserted in the counterpart, the fastening system is put into its locked condition by bayonet fitting, that is to say by rotating the rigid sleeve about the axis XX', and therefore rotation of the rigid sleeve with respect to the flexible annular ring. The high tension module can then be put in position on the bulb base.

The positioning tongue is a leaf spring which enables the lamp to be pushed in the base of the V-shaped housing formed in the counterpart. The purpose of this positioning tongue is to take up those clearances which may exist between the lamp and counterpart, by pushing the lamp radially into the V-shaped housing formed in the counterpart. For that purpose, the positioning tongue is located radially opposite the V. The rigid sleeve has a lug which, when it is put into its locked position, pushes the positioning tongue towards the centre of the system, so pushing the lamp radially in such a way that it is located in the V-shaped housing in the counterpart.

The positioning lug can also serve as a locating device during fitting of the lamp on the counterpart, that is to say it offers only one possible position during fitting.

When the lamp is mounted in the counterpart, the holding tongues will then retain the lamp in that position.

Figure 6A:
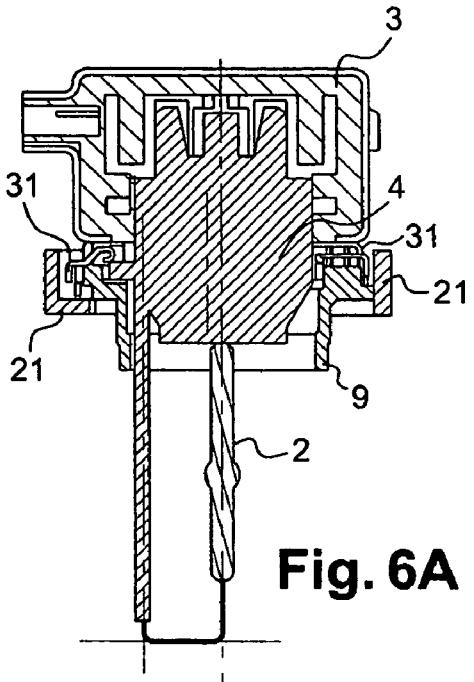
FIGS. 6A to 6D show side views in cross section and top plan views in is cross section, of the fastening system of the invention having a D1 light source, in the unlocked state and the locked state respectively.
Figure 6C:
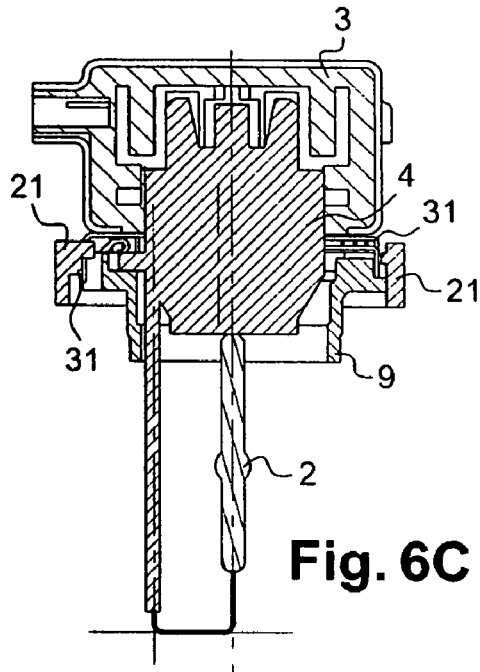
Figure 6B:
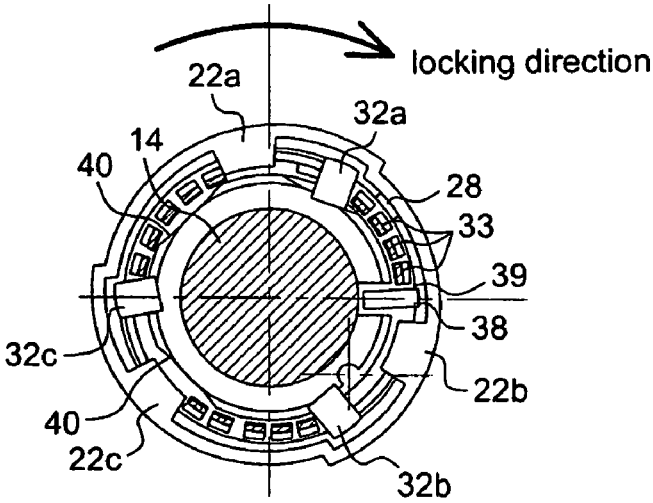
Figure 6D:
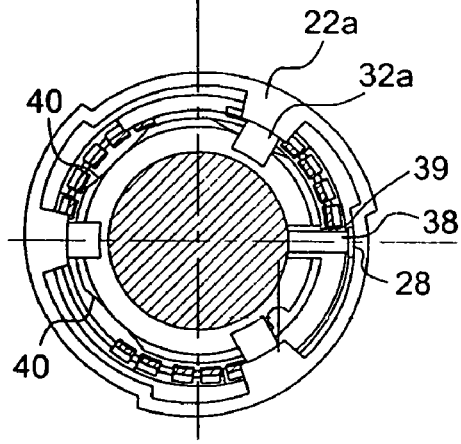

FIGS. 6A and 6C show side views of the fastening system of the invention in cross section, in the case where the lamp is a D1 lamp, and where the system is in its unlocked and locked positions respectively. FIGS. 6B and 6D are top plan views of the fastening system of the invention with a D1 lamp, where the system is in its unlocked and locked states respectively. FIGS. 6A and 6B show the position of the rigid sleeve 21 and flexible ring 31 where the system is unlocked. In particular, they show the position of the first lugs 22*a*, 22*b*, 22*c* of the rigid sleeve with respect to the holding tongues 32*a*, 32*b*, 32*c* of the flexible ring. These Figures also show the position of the second lug 28 with respect to the positioning tongues 38 of the flexible ring 31. In the unlocked condition, the positioning tongue 38 is lodged in a housing of the bulb base, but it is skewed within the said housing. Locking of the system enables this tongue to exert a radial thrust on the lamp, so as to push the lamp to the base of the V-shaped housing in the counterpart. The V-shaped housing is represented in FIG. 6B by two flats 40 which are situated radially opposite the housing 35 which receives the positioning tongue 38. FIGS. 6A and 6B also show the positioning of the contact tongues 33 between the holding tongues 32. It is thus easily possible to see the differences in dimensions which may exist between the various sorts of tongues.

FIGS. 6C and 6D represent the fastening system in the case of a D1 lamp where the system is in its locked state. It will be understood, from a study of FIGS. 6C and 6D in comparison with FIGS. 6A and 6B that, where the rigid sleeve is in the unlocked condition, the first and second lugs of the sleeve are not in engagement against any tongue. On the contrary, when the rigid sleeve has been rotated through about 40° with respect to the flexible annular ring, the first lugs 22 come into position in front of the holding tongues 32, and the second lug 28 in front of the positioning tongue 38. The positioning of these lugs may take place in a predetermined way, that is to say that the second lug 28 is positioned before the first lugs 22. This rotation of the rigid sleeve has the consequence that the holding lugs are pushed towards the bulb base, so making the flexible annular ring totally circular. Another consequence is that the positioning tongue is pushed to the base of its housing 39, enabling it to exert a pressure which locates the D1 lamp in the V-shaped housing.

The rigid sleeve 21 thus acts as a cam on the flexible ring 31.

Figure 7A:
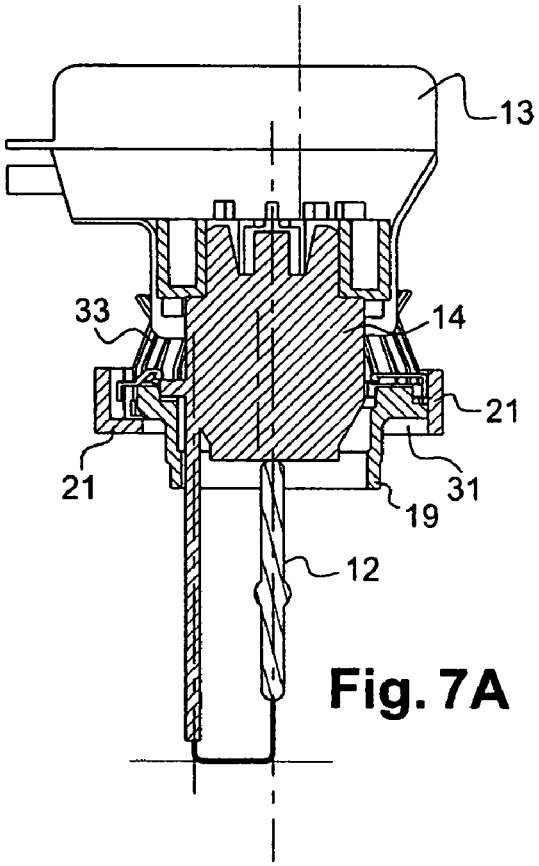
FIGS. 7A to 7D are side views in cross section and top plan views in cross section of the fastening system of the invention with a D2 light source, shown in the unlocked state and the locked state respectively.
Figure 7C:
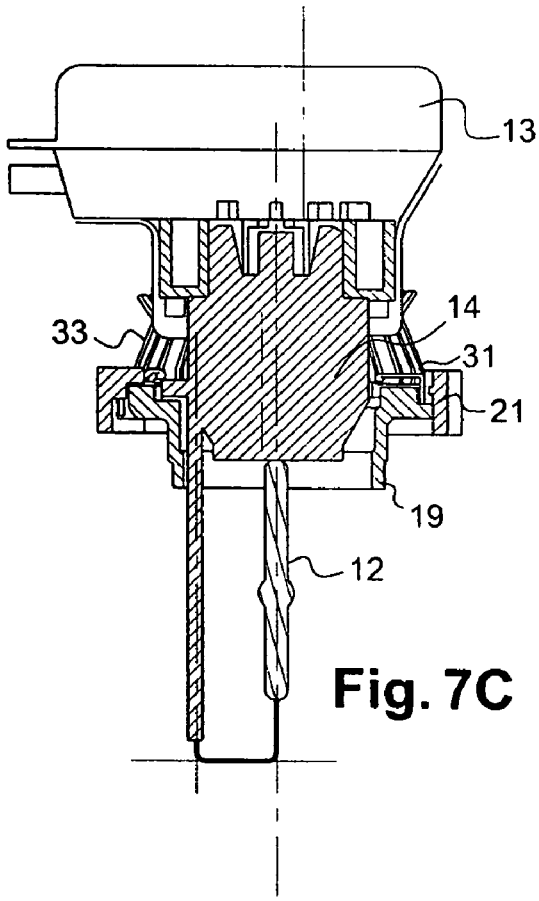
Figure 7B:
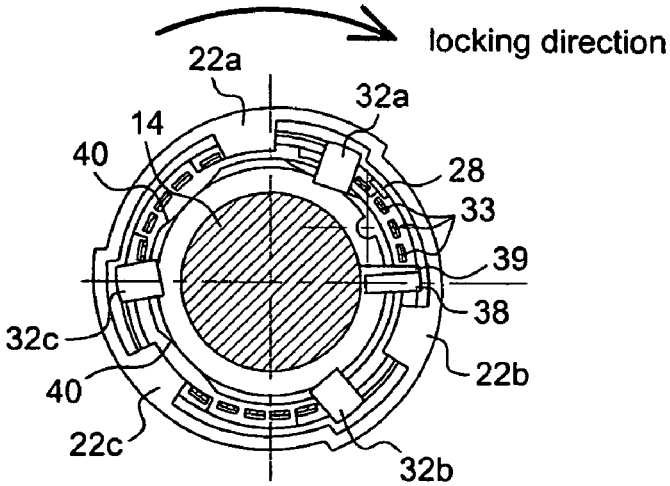
Figure 7D:
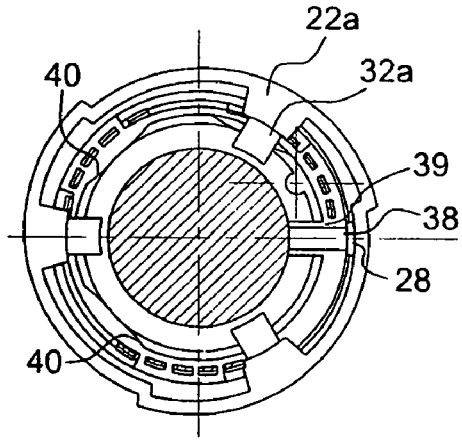

FIGS. 7A and 7C show side views of the fastening system of the invention in cross section, in the case where the lamp is a D2 lamp, and where the system is in its unlocked and locked positions respectively. FIGS. 7B and 7D are top plan views of the fastening system of the invention with a D2 lamp, where the system is in its unlocked and locked states respectively. FIGS. 7A and 7B show the position of the rigid sleeve 21 and flexible ring 31 where the system is unlocked. In particular, they show the position of the first lugs 22*a*, 22*b*, 22*c* of the rigid sleeve with respect to the holding tongues 32*a*, 32*b*, 32*c* of the flexible ring. These Figures also show the position of the second lug 28 with respect to the positioning tongues 38 of the flexible ring 31. In the unlocked condition, the positioning tongue 38 is lodged in a housing of the bulb base, but it is skewed within the said housing. Locking of the system enables this tongue to exert a radial thrust on the lamp, so as to push the lamp to the base of the V-shaped housing in the counterpart. The V-shaped housing is represented in FIG. 7B by two flats 40 which are situated radially opposite the housing 35 which receives the positioning tongue 38. FIGS. 7A and 7B also show the positioning of the contact tongues 33 between the holding tongues 32. It is thus easily possible to see the differences in dimensions which may exist between the various sorts of tongues.

FIGS. 7C and 7D represent the fastening system in the case of a D2 lamp where the system is in its locked state. It will be understood, from a study of FIGS. 7C and 7D in comparison with FIGS. 7A and 7B that, where the rigid sleeve is in the unlocked condition, the first and second lugs of the sleeve are not in engagement against any tongue. On the contrary, when the rigid sleeve has been rotated through about 40° with respect to the flexible annular ring, the first lugs 22 come into position in front of the holding tongues 32, and the second lug 28 in front of the positioning tongue 38. The positioning of these lugs may take place in a predetermined way, that is to say that the second lug 28 is positioned before the first lugs 22. This rotation of the rigid sleeve has the consequence that the holding lugs are pushed towards the bulb base, so making the flexible annular ring totally circular. Another consequence is that the positioning tongue is pushed to the base of its housing 39, enabling it to exert a pressure which locates the D2 lamp in the V-shaped housing.

It will therefore be understood that, after the system has been locked up, the flexible ring 31 provides the mechanical strength and positioning for a D1 or D2 lamp on the counterpart, as well as electrical continuity and electromagnetic screening between the counterpart and the high tension module. Before locking, it serves as the preliminary holding means for the lamp, because the internal diameter of the circle on which the holding tongues are distributed in the unlocked condition is smaller than the outer diameter of the neck of the lamp.

It will also be understood from the foregoing description that the system is identical for a D1 lamp and for a D2 lamp, with only the length of the contact tongues being able to be different. The contact tongues can thus be chosen in such a way as to have a similar profile for D1 and for D2, which enables the manufacture of the system to be simplified even more.

In this way, the headlight is standard for a D1 lamp and for a D2 lamp. It can also be made by mass production, and it is simply at the time of installation of the light source that it will be chosen, if need be, that a flexible ring with large contact tongues for a D2 lamp, or one with small contact tongues for a D1 lamp, is to be selected. It is also possible to fit a D1 lamp or a D2 lamp according to choice, and according to the cost and availability of one or other of these lamps.

What is claimed is:

1. Apparatus for projecting light, for a motor vehicle, comprising:

(a) light source having a discharge bulb, a high tension module, and a bulb base for making the connection between the bulb and the high tension module, (b) a counterpart comprising a reflector and a lamp holder, with the said lamp holder holding the bulb in front of the reflector, and (c) a fastening system for fixing the light source on the counterpart and situated at least partly around the lamp holder, wherein the fastening system comprises:

(i) a rotatable rigid sleeve, and (ii) an electrically conductive flexible annular ring situated inside the rigid sleeve and having tongues, at least one tongue being in at least one of electrical or mechanical contact with the light source.

2. Apparatus for projecting light according to claim 1, wherein the flexible ring is movable radially, and is not rotatable.

3. Apparatus for projecting light according to claim 1, wherein at least one of the tongues is a mechanical holding tongue.

4. Apparatus for projecting light according to claim 1, wherein at least one of the tongues is an electrical contact tongue.

5. Apparatus for projecting light according to claim 1, wherein at least one of the tongues is a positioning tongue for the light source.

6. Apparatus for projecting light according to claim 5, wherein the holding and positioning tongues are movable radially, with an unlocked position and a locked position.

7. Apparatus for projecting light according to claim 1, wherein the rigid sleeve includes, on an internal face, at least one first lug which is adapted to push on the holding tongue and to maintain it in a locked position.

8. Apparatus for projecting light according to claim 1, wherein the rigid sleeve includes, on an internal face, at least one second lug which is adapted to push on the positioning tongues and to maintain it in a locked position.

9. A method of fastening a light source on a counterpart in an apparatus for projecting light according to claim 1, wherein it includes the following steps:

(a) positioning and fixing the fastening system around one end of a lamp holder of the counterpart, (b) inserting a discharge bulb of the light source within the counterpart until a bulb foot of the light source comes into engagement on the fastening system or the counterpart, and (c) locking the fastening system by rotation of a part of the said system.

10. A fastening method according to claim 9, wherein the locking of the fastening system consists in causing the rigid sleeve to be rotated with respect to the flexible annular ring and with respect to the counterpart.

11. A fastening method according to claim 9, wherein the fastening system is fitted on the lamp holder by exertion of a force to effect snap-fitting and locking.

12. A motor vehicle, wherein it includes at least one apparatus for projecting light according to claim 1.

* * * * *